United States Patent [19]

Itoh

[11] 4,373,801

[45] Feb. 15, 1983

[54] FIXING TEMPERATURE SELECTING CONTROL IN A COPYING MACHINE

[75] Inventor: Fukusaburo Itoh, Yamatokoriyama, Japan

[73] Assignee: Sharp Kabushiki Kaisha, Osaka, Japan

[21] Appl. No.: 88,660

[22] Filed: Oct. 26, 1979

[30] Foreign Application Priority Data

Oct. 27, 1978 [JP] Japan ..... 53-132795

[51] Int. Cl.[3] ..... G03G 15/20

[52] U.S. Cl. ..... 355/14 FU; 219/216; 355/3 FU; 432/60

[58] Field of Search ..... 355/3 R, 3 FU, 14 FU; 219/216; 432/60

[56] References Cited

U.S. PATENT DOCUMENTS 3,053,962 9/1962 Cerasani et al. ..... 355/3 FU X
3,781,516 12/1973 Tsilibes et al. ..... 219/216
3,926,519 12/1975 Rebres ..... 355/14 FU
4,136,941 1/1979 Sawaoka ..... 355/3 R

OTHER PUBLICATIONS

Jachimiak et al., "Fusing of Offset Masters", IBM Technical Disclosure Bulletin, vol. 18, No. 4, Sep. 1975, p. 1004.

Howard et al., "Copier Fusing Controls", IBM Technical Disclosure Bulletin, vol. 21, No. 2, Jul. 1978, pp. 481 and 482.

*Primary Examiner*—Fred L. Braun

*Attorney, Agent, or Firm*—Birch, Stewart, Kolasch & Birch

[57] ABSTRACT

A copying machine having a thermal fixing circuit, and a fixing temperature controlling system for regulating a desired fixing temperature in accordance with variations of copy paper characteristics. A first manual copy switch is actuated for selecting a normal fixing temperature when a normal, thin copy paper is used. A second manual copy switch is actuated for selecting a higher fixing temperature when a thick copy paper is used.

3 Claims, 5 Drawing Figures

FIXING TEMPERATURE SELECTING CONTROL IN A COPYING MACHINE

BACKGROUND AND SUMMARY OF THE INVENTION

The present invention relates to a fixing system for fixing a toner image formed on a copy paper in a copying machine and, more particularly, to a control system for selecting a desired fixing temperature in accordance with the quality and the specific gravity of the copy paper being used.

In the conventional electrophotographic copying machine, a specific copy paper suited for the machine is used to ensure a clean copy. However, it is desirable to allow various kinds of copy paper to be used without deteriorating the copying quality. In the case where a copy paper of a large specific gravity is used, the fixing temperature should be raised to completely perform the fixing. In the case where a copy paper of a small specific gravity is used, the fixing temperature should be lowered to prevent the copy paper from burning.

Accordingly, an object of the present invention is to provide a novel thermal fixing system for fixing a toner image formed on a copy paper in an electrophotographic copying machine.

Another object of the present invention is to provide a fixing temperature control system for selecting a desired fixing temperature in accordance with variations of the copy paper characteristics.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, two copy switches are provided for a thick paper copy mode and a thin paper copy mode, respectively. A fixing temperature control circuit is associated with the two copy switches in order to control the operation mode of a thermal fixing system for fixing a toner image formed on a copy paper. When a thick paper copy mode switch is actuated, the fixing temperature control circuit activates the thermal fixing system to operate in a higher temperature mode. When a thin paper copy mode switch is actuated, the fixing temperature control circuit activates the thermal fixing system to operate in a lower temperature mode.

BRIEF DESCRIPTION OF THE DRAWINGS

The present invention will be better understood from the detailed description given hereinbelow and the accompanying drawings which are given by way of illustration only, and thus are not limitative of the present invention and wherein.

DESCRIPTION OF THE PREFERRED EMBODIMENTS

Figure 1:
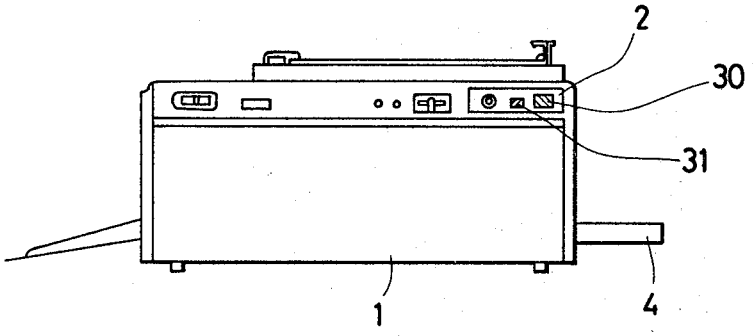
FIG. 1 is a front view of an electrophotographic copying machine employing an embodiment of a fixing temperature control system of the present invention.

FIG. 1 shows an electrophotographic copying machine employing an embodiment of a fixing temperature control system of the present invention.

An electrophotographic copying machine 1 mainly comprises a control panel 2, and a copy paper reservoir 4. Two copy switches 30 and 31 are disposed on the control panel 2, the first copy switch 30 being for conducting a copying operation onto a normal copy paper (thin copy paper), and the second copy switch 31 being for conducting a copying operation onto a thick copy paper.

Figure 2:
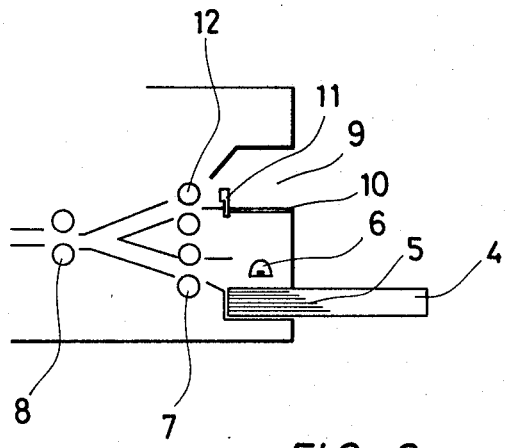
FIG. 2 is a sectional view of a paper supply section included in the electrophotographic copying machine of FIG. 1.

The copy paper reservoir 4 retains the normal copy paper 5 (thin copy paper) therein, and is removably secured to a paper supply section of the copying machine 1 as shown in FIG. 2. The paper supply section comprises a paper feed roller 6, which is responsive to the first copy switch 30, for supplying the normal copy paper 5 (thin copy paper) from the copy paper reservoir 4 to a transcription section through feed rollers 7 and 8. The copy paper is further fed to a thermal fixing section (not shown) for fixing a toner image formed on the copy paper. Of course the paper feed is timed in agreement with the image formation on a photosensitive drum as is well known in the art.

The paper supply section further comprises a manual paper inlet 9, a paper feed table 10, a detection switch 11, and a paper feed roller 12. These elements are provided for allowing the manual paper supply. When, for example, a thick copy paper is manually introduced through the manual paper inlet 9, the detection switch 11 is actuated to energize the copying machine components. Of course the paper feed is timed in agreement with the image formation on the photosensitive drum through the use of a temporary paper holding mechanism as is well known in the art.

The above-mentioned electrophotographic copying machine is normally placed in the initial condition, wherein the fixing temperature is set at a preselected first value suited for the normal copy paper (thin copy paper). When the fixing temperature reaches the preselected first value, a ready lamp is enabled to indicate the standby condition. Thereafter, when the first copy switch 30 is actuated, the normal copy paper 5 (thin copy paper) is supplied from the copy paper reservoir 4 through the paper feed roller 6.

Now assume that a thick copy paper is introduced through the manual paper inlet 9. At this moment, the detection switch 11 develops a detection output. When the second copy switch 31 is actuated, the fixing section is placed into a second mode wherein the fixing temperature is maintained at a preselected second value (higher than the first value) suited for the thick paper fixing. The actual copying operation is suspended till the fixing section temperature reaches the preselected second value. When the fixing section temperature reaches the preselected second value, the thick copy paper is transferred to the transcription section through the feed rollers 12 and 8 in synchronization with the rotation of the photosensitive drum.

Figure 3:
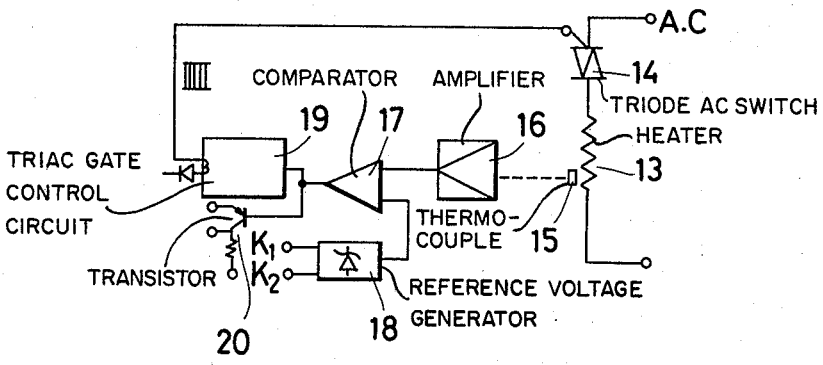
FIG. 3 is a circuit diagram of an embodiment of a fixing temperature control circuit of the present invention.

FIG. 3 shows an embodiment of a fixing temperature control circuit of the present invention.

The fixing section includes a heater 13, which is power supplied from an A.C. power source through a triode AC switch 14 (trade name TRIAC), for performing the thermal fixing operation. A thermocouple 15 is disposed near the passage of the copy paper in the fixing section for detecting the fixing temperature.

An output voltage signal of the thermocouple 15 is applied to one input terminal of a comparator 17 through an amplifier 16. The other input terminal of the comparator 17 receives a reference voltage signal derived from a reference voltage generator 18. That is, the comparator 17 develops an output signal to a triac gate control circuit 19 in accordance with the comparison determination between the output voltage derived from the thermocouple 15 and the reference voltage signal.

When the reference voltage signal ($V_N$) is greater than the output voltage signal ($V_I$) from the thermocouple 15, the triac gate control circuit 19 develops a control signal for turning on the TRIAC 14, thereby energizing the heater 13. The gate control is based on the well-known zero-cross control method.

The reference voltage generator 18 is provided with terminals $K_1$ and $K_2$ associated with the first and second copy switches 30 and 31, respectively. When the first copy switch 30 is actuated, a signal is applied to the first terminal $K_1$, whereby the reference voltage generator 18 develops a reference voltage $V_N$ suited for the normal copy paper fixing operation. The first terminal $K_1$ also receives the signal at the initial condition setting mode, whereby the fixing section is normally held at a temperature suited for the normal copy paper (thin copy paper). When the second copy switch 31 is actuated, a signal is applied to the second terminal $K_2$ for developing a reference voltage $V_N$ suited for the thick paper fixing.

When the main power switch is turned on, the heater 13 is energized to raise the temperature in the fixing section. When the temperature reaches the preselected first value, the output voltage $V_I$ of the thermocouple 15 exceeds the reference voltage $V_N$ and, therefore, the TRIAC 14 is turned off by the gate control circuit 19. Accordingly, the energization of the heater 13 is terminated. That is, the copying machine is placed in the standby condition when $V_N < V_I$. At this moment, the ready lamp is enabled. When the temperature in the fixing section decreases below the preselected first value, the detection output is developed from the comparator 17 to turn on the TRIAC 14.

Figure 4:
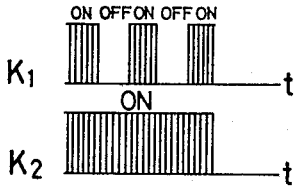
FIG. 4 is a time chart showing a waveform of a control signal occurring within the fixing temperature control circuit of FIG. 3.

In this manner, the fixing temperature is maintained at the preselected first value. FIG. 4 shows a gate control signal $K_1$ applied from the gate control circuit 19 to the TRIAC 14 under the thin paper copy mode.

When the second copy switch 31 is actuated, the terminal $K_2$ receives the signal for developing the reference voltage $V_N$ suited for the thick paper copying operation. When $V_N \geqq V_I$, the heater 13 receives the power supply through the TRIAC 14, and the power supply to the heater 13 is precluded when $V_N < V_I$.

In this manner, the fixing temperature is maintained at the preselected second value. FIG. 4 shows a gate control signal $K_2$ applied from the gate control circuit 19 to the TRIAC 14 under the thick paper copy mode.

The actual copying operation must be suspended till the fixing section temperature reaches the preselected second value when the second copy switch 31 is actuated. The fixing temperature control circuit further includes a transistor 20 of which the base electrode is connected to receive a signal derived from the comparator 17. When the reference voltage $V_N$ is smaller than the output voltage $V_I$, the transistor 20 is turned on to conduct the actual copying operation. Of course the transistor 20 can be associated with the ready lamp.

The system can be constructed to be placed in the thick paper copy mode when the detection switcn 11 develops the detection output.

Figure 5:
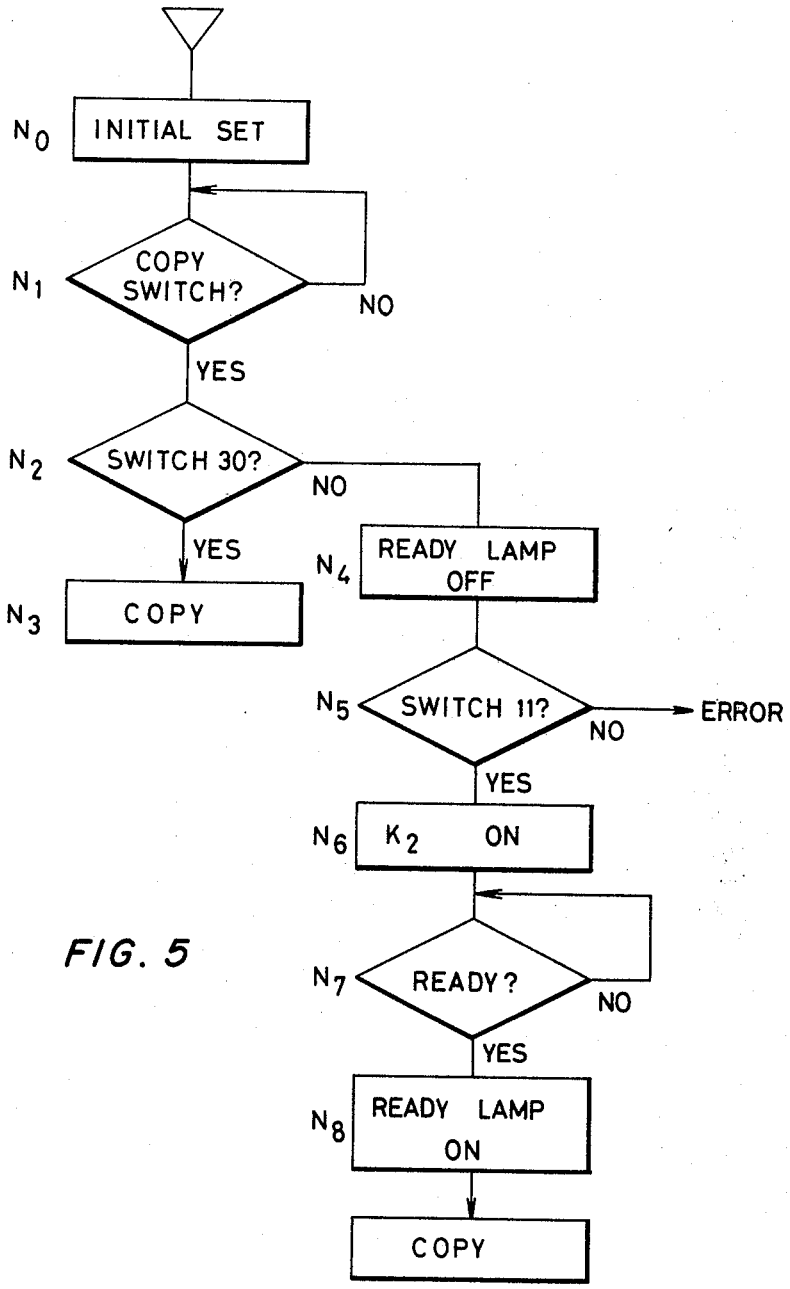
FIG. 5 is a flow chart for explaining an operation mode of the electrophotographic copying machine of FIG. 1.

The operation flow of the copying machine in the temperature control mode is shown in FIG. 5.

When the main power supply switch is turned on, the copying machine is set in the initial condition at the step $N_0$, wherein the fixing temperature is set at the predetermined first value suited for the normal, thin paper copying operation. After completion of the initial setting, the program is advanced to the second step $N_1$, wherein the actuation of the copy switches 30 and 31 is detected. When one of the copy switches 30 and 31 is actuated, the program is advanced to the following step $N_2$, wherein the determination as to which one of the copy switches 30 and 31 is actuated. In case the first copy switch 30 is actuated, the program is advanced to the step $N_3$ for conducting copying operation onto the normal, thin copy paper.

In case the second copy switch 31 is actuated, the program is advanced to the step $N_4$ for the thick paper copying mode. At the step $N_4$ the ready lamp is disabled if the ready lamp has been enabled. At the following step $N_5$ the condition of the detection switch 11 is checked. When the detection switch 11 is in the on condition due to the thick copy paper introduced through the manual paper inlet 9, the program is advanced to the step $N_6$. If the detection switch 11 is in the off condition, the program is advanced to the error routine. The program can be returned to the step $N_1$ through the error routine.

At the step $N_6$, the control signal is applied to the second terminal $K_2$ of the reference voltage generator 18 to develop the reference voltage $V_N$ suited for the thick paper fixing toward the comparator 17. When the fixing temperature reaches the second preselected value suited for the thick paper fixing, the program is advanced to the step $N_8$ via the step $N_7$. At the step $N_8$, the ready lamp is enabled through the transistor 20. Thereafter, the actual copying operation is conducted onto the thick copy paper.

The invention being thus described, it will be obvious that the same may be varied in many ways. Such variations are not to be regarded as a departure from the spirit and scope of the invention, and all such modifications are intended to be included within the scope of the following claims.

What is claimed is:

1. An electrophotographic copying machine capable of varying the fixing temperature for fusing a toner image formed on copy paper comprising:

a means for forming a toner image on the surface of said copy paper, a thermal fixing system for fixing said toner image on the surface of said copy paper, a fixing temperature control circuit which activates said thermal fixing system, a first manual switch which initiates the copying operation of said copying machine and said fixing temperature control circuit to activate said thermal fixing system to generate a first temperature for fixing said toner image to a first copy paper, and a second manual switch which initiates the copying operation of said copying machine and said fixing temperature control circuit to activate said thermal fixing system to generate a second temperature for fixing said toner image to a second copy paper.

2. The copying machine of claim 1, wherein said first copy paper is a thin copy paper having a small specific gravity and said first temperature is a correspondingly low fixing temperature, and said second copy paper is a thick copy paper having a large specific gravity and said second temperature is a correspondingly high fixing temperature.

3. The copying machine of claim 2, further including a detection switch which develops a detection output which responds to the introduction of said thick copy paper.

* * * * *